US010434523B2

(12) United States Patent
Santeler et al.

(10) Patent No.: US 10,434,523 B2
(45) Date of Patent: Oct. 8, 2019

(54) MULTISTAGE SEPARATOR ASSEMBLY

(71) Applicant: EATON CORPORATION, Cleveland, OH (US)

(72) Inventors: Keith Allen Santeler, Clifton Heights, PA (US); Rolland Tracy James, Collingswood, NJ (US); Stephen Showalter, Milmont Park, PA (US)

(73) Assignee: Eaton Intelligent Power Limited, Dublin (IE)

( * ) Notice: Subject to any disclaimer, the term of this patent is extended or adjusted under 35 U.S.C. 154(b) by 399 days.

(21) Appl. No.: 15/305,620

(22) PCT Filed: May 1, 2015

(86) PCT No.: PCT/US2015/028811

§ 371 (c)(1),
(2) Date: Oct. 20, 2016

(87) PCT Pub. No.: WO2015/168567

PCT Pub. Date: Nov. 5, 2015

(65) Prior Publication Data

US 2017/0056894 A1 Mar. 2, 2017

Related U.S. Application Data

(60) Provisional application No. 61/987,627, filed on May 2, 2014.

(51) Int. Cl.

| | |
|---|---|
| ***B04C 3/06*** | (2006.01) |
| ***B04C 5/14*** | (2006.01) |
| ***B04C 3/00*** | (2006.01) |

(52) U.S. Cl.

CPC ..... *B04C 3/06* (2013.01); *B04C 5/14* (2013.01); *B04C 2003/003* (2013.01)

(58) Field of Classification Search

CPC ..... B04C 3/06; B04C 5/14; B04C 2003/003
See application file for complete search history.

(56) References Cited

U.S. PATENT DOCUMENTS

| | | | |
|---|---|---|---|
| 2,967,618 | A | 1/1961 | Vane |
| 4,008,059 | A | 2/1977 | Monson et al. |
| 7,288,139 | B1 | 10/2007 | Showalter |

FOREIGN PATENT DOCUMENTS

| | | | |
|---|---|---|---|
| EP | 0267285 | A1 | 5/1988 |

OTHER PUBLICATIONS

The International Preliminary Report on Patentability (Chapter I) for PCT/US2015/02811, dated Nov. 8, 2016. (Year: 2016).*

(Continued)

*Primary Examiner* — David A Reifsnyder
(74) *Attorney, Agent, or Firm* — Fishman Stewart PLLC

(57) ABSTRACT

A separator assembly is provided for, among other things, separating debris particles from a fluid in a fluid system. In an embodiment, the separator assembly may include a housing forming an internal chamber. An inlet port may be in communication with the internal chamber of the housing, and the inlet port can be oriented in a tangential relationship relative to the internal chamber. A first debris separation ring may be disposed in the housing and can extend around an inner surface of the internal chamber. A second debris separation ring can be disposed in the housing and can extend around the inner surface of the internal chamber, wherein the second debris separation ring may be spaced from the first debris separation ring.

23 Claims, 5 Drawing Sheets

(56) References Cited

OTHER PUBLICATIONS

International Search Report, PCT/US2015/028811, dated Aug. 6, 2015.

* cited by examiner

MULTISTAGE SEPARATOR ASSEMBLY

CROSS-REFERENCE TO RELATED APPLICATION

This application is a national stage filing based upon International PCT Application No. PCT/US2015/028811, with an international filing date of May 1, 2015, which claims the benefit of U.S. Provisional Patent Application No. 61/987,627, filed May 2, 2014, the entire disclosures of which are hereby incorporated by reference as though fully set forth herein.

TECHNICAL FIELD

The present disclosure relates to devices for separating and capturing debris particles from a fluid circulating through a fluid system, including a separator assembly having multiple separator stages to discretize debris particles of differing sizes and weights.

BACKGROUND

Separator assemblies can be used in a wide-variety of fluid systems, such as fluid lubrication systems, to separate and capture debris particles from fluid circulating through the system. One type of separator assembly, for example, is a cyclonic separator. A cyclonic separator assembly may generally include a circular cylindrical housing having a first or top end and a second or bottom end. The first end may be closed by an end wall and the second end may define an opening. An inlet for fluid may be located near the first end of the housing. The inlet can define a flow path that opens in a generally tangential direction within the housing. The separator assembly may also include a debris separation wall disposed within the housing. The debris separation wall may circumferentially extend around an inner surface of the housing and can define an annular collection region.

When fluid enters the housing via the inlet, the fluid can be directed in a cyclonic flow pattern as a result of gravity and the inlet being tangential to the circular cylindrical housing. As the fluid flows in a cyclonic motion down through the housing, debris particles may migrate radially outwardly within the fluid toward the inner surface of the housing due to centrifugal forces. As the fluid flows downwardly over the separation wall, the debris particles may be captured in the collection region of the separation wall. The fluid may then exit the housing through the opening in the second end.

A sensor may be provided near the collection region to detect accumulation of debris particles. The sensor may also provide a signal when the size of captured particles reaches a predetermined threshold. However, the accumulation of relatively smaller debris particles can build up and, over time, may exceed a saturation mass of the sensor. As a result, this may "blind" the sensor from detecting debris particles that are of particular interest.

Thus, although known separator assemblies may function in an acceptable manner, it would be desirable to provide an improved separator assembly having multiple separator stages to discretize particles of differing sizes and weights and to provide improved separation of debris particles.

SUMMARY

A separator assembly is provided for, among other things, separating debris particles from a fluid in a fluid system. In an embodiment, the separator assembly may include a housing forming an internal chamber. An inlet port may be in fluid communication with the internal chamber, and the inlet port can be oriented in a tangential relationship relative to the internal chamber of the housing. A first debris separation ring may be disposed in the housing and can extend around an inner surface of the internal chamber. A second debris separation ring can be disposed in the housing and can extend around the inner surface of the internal chamber, wherein the second debris separation ring may be spaced from the first debris separation ring.

Various aspects of the present disclosure will become apparent to those skilled in the art from the following detailed description of the various embodiments, when read in light of the accompanying drawings.

BRIEF DESCRIPTION OF THE DRAWINGS

Embodiments of the present disclosure will now be described, by way of example, with reference to the accompanying drawings.

DETAILED DESCRIPTION

Figure 1:
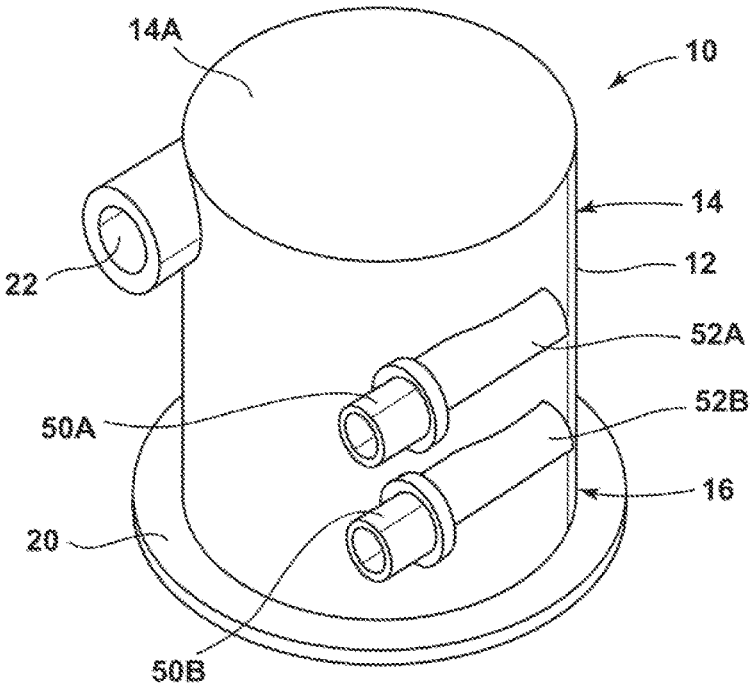
FIG. 1 is a perspective view of a separator assembly according to an embodiment of the present disclosure.
Figure 2:
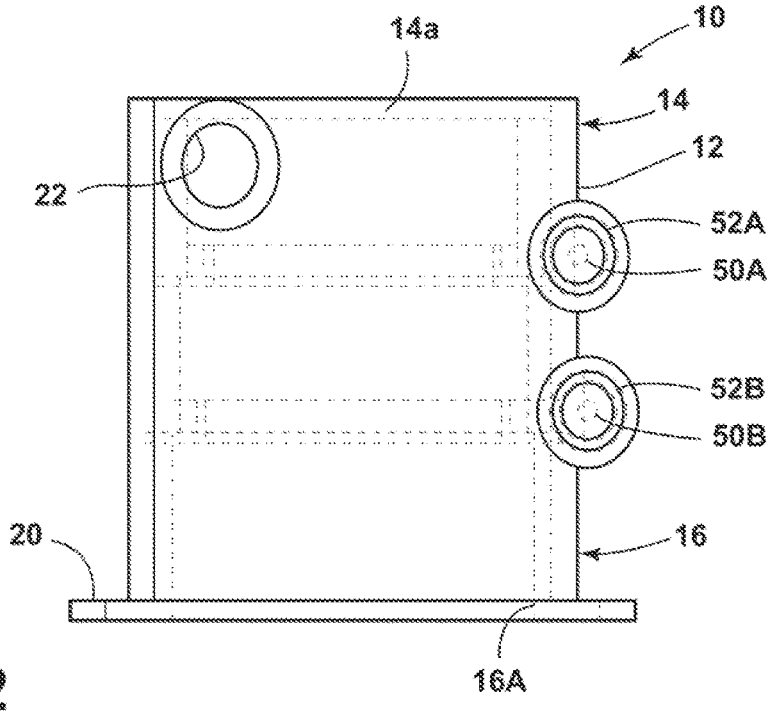
FIG. 2 is a front elevational view of the separator assembly shown in FIG. 1.
Figure 3:
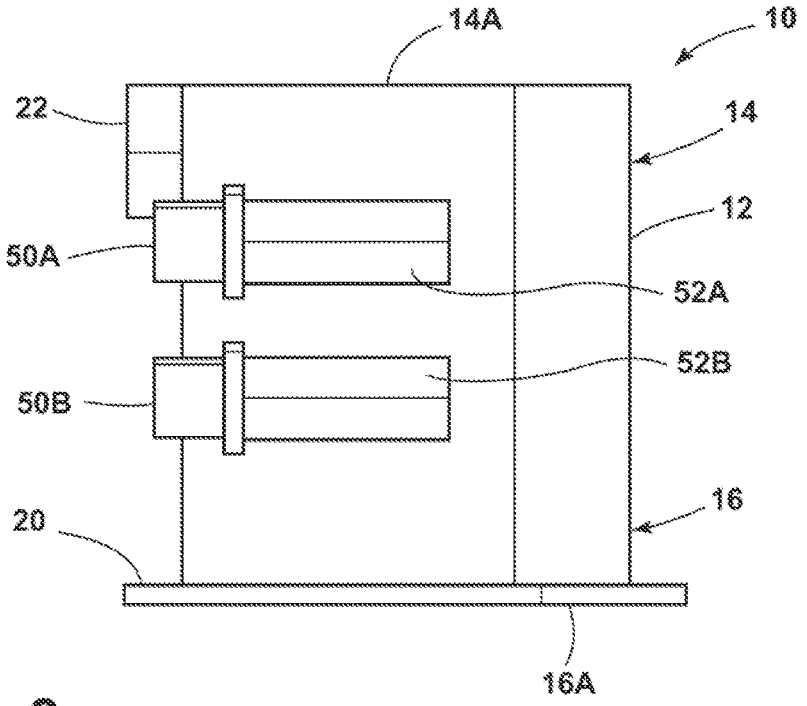
FIG. 3 is a side elevational view of the separator assembly shown in FIG. 1.
Figure 4:
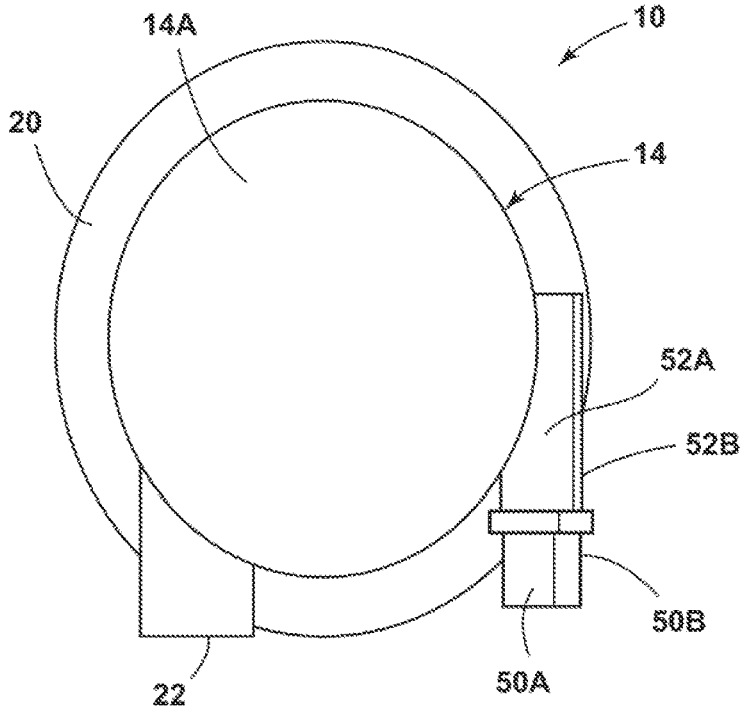
FIG. 4 is a top view of the separator assembly shown in FIG. 1.

Reference will now be made in detail to embodiments of the present disclosure, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Referring now to FIGS. 1-4, a separator assembly according to an embodiment of the present disclosure is generally illustrated at 10. The separator assembly 10 can be used in a wide-variety of fluid systems to, among other things, separate and capture unwanted debris particles from the fluid circulating through the system. For example, in a non-limiting embodiment, the separator assembly 10 can be used in a fluid lubrication system, such as a turbine engine lubrication system provided in an aircraft. It should be appreciated, however, that the separator assembly 10 can be used in other suitable environments and for other suitable purposes.

As generally shown, the separator assembly 10 may include a housing 12. The housing 12 can be a substantially circular cylindrical housing generally having a first end 14 and a second end 16. In a non-limiting embodiment, the first end 14 may be a top of the separator assembly 10 and the second end 16 may be a bottom of the separator assembly 10, respectively. The first end 14 of the housing 12 may comprise an end wall 14A and the second end 16 may define an outlet opening 16A. The housing 12 may form an internal chamber 18 (see FIG. 5), such as generally disclosed in further detail below. It should be appreciated, however, that the housing 12 may have other suitable shapes or configurations. The housing 12 may also have any suitable dimensions for an intended application.

In a non-limiting embodiment, the separator assembly 10 may include a support flange 20. For example, the support flange 20 may be configured to support the separator assembly 10 on a reservoir or other suitable structure of the lubrication system. As generally shown, the support flange 20 may be provided near the second end 16 of the housing 12 and can radially extend outwardly from an outer surface of the housing 12, although such is not required. In turn, the support flange 20 may be secured to the reservoir or other support structure using threaded fasteners or another suitable connection. It should be appreciated, however, that the separator assembly 10 may include other suitable support members or can be secured to the reservoir in other ways without departing from the scope of the present disclosure.

The separator assembly 10 may also include an inlet port 22 that can be configured to supply fluid to the housing 12. For example, the inlet port 22 can define a fluid path that extends through a side wall of the housing 12 for fluid communication with the internal chamber 18 (see FIG. 5). In an embodiment, the inlet port 22 may be located near the first end 14 of the housing 12, although such is not necessarily required.

As generally shown, the inlet port 22 may be oriented in a tangential relationship relative to the housing 12. In other words, the inlet port 22 can be generally perpendicular to a longitudinal axis of the housing 12 and radially spaced from the longitudinal axis. As such, the fluid path defined by the inlet port 22 may enter the internal chamber 18 (see FIG. 5) adjacent and tangentially to an inner surface of the housing 12. At least one aspect of this orientation is generally disclosed further below.

Figure 5:
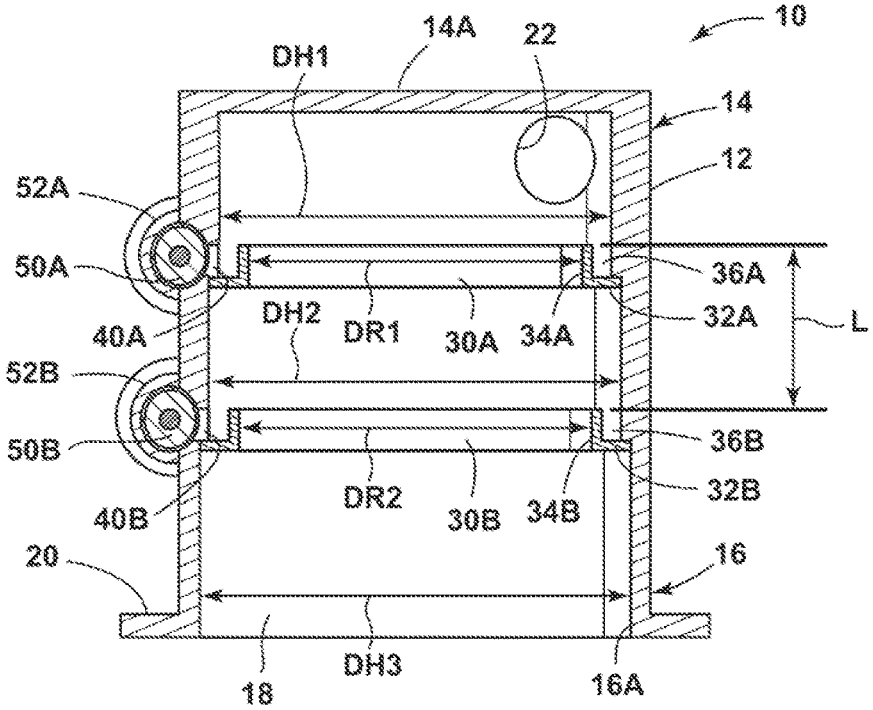
FIG. 5 is a front cross-sectional view of the separator assembly shown in FIG. 1.

Referring now to FIG. 5 and as generally explained above, the housing 12 may form an internal chamber 18. In a non-limiting embodiment, the internal chamber 18 may be a substantially circular cylindrical chamber defined by the inner surface of the housing 12. The internal chamber 18 may be closed at the first end 14 of the housing 12 by the end wall 14A and open at the second end 16 via the outlet opening 16A. In other embodiments, however, the internal chamber 18 may have other suitable shapes or configurations.

In another embodiment, the separator assembly 10, for example, as shown in FIGS. 7-10, may be configured to separate debris and air from fluid circulating within the housing 12. As generally illustrated, the end wall 14A may include an opening 24. The opening 24 may be disposed at an end of a cylindrical bore 26 defined by an axially extending wall 28. The axially extending wall 28 may extend axially with respect to the end wall 14A and into the internal chamber 18. The cylindrical bore 26 may be in communication with the internal chamber 18. As fluid circulates through the housing 12, air may be separated from the fluid and vented out of the internal chamber 18 and through the cylindrical bore 26.

Figure 6:
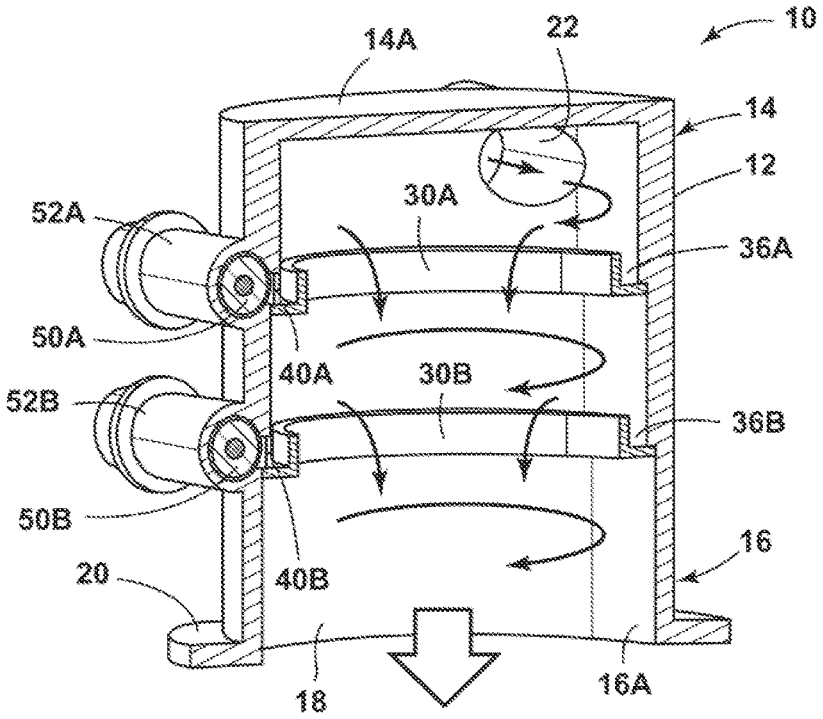
FIG. 6 is a perspective cross-sectional view of the separator assembly as shown in FIG. 5 illustrating a flow pattern of fluid passing through the separator assembly.
Figure 7:
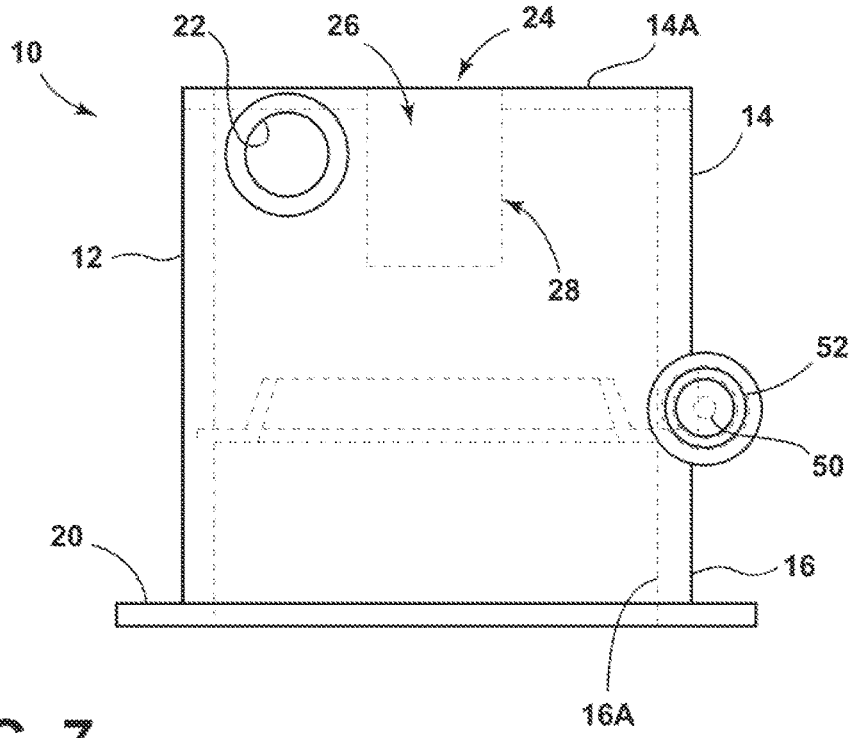
FIG. 7 is a front elevational view of an alternative separator assembly according to an embodiment of the present disclosure.
Figure 8:
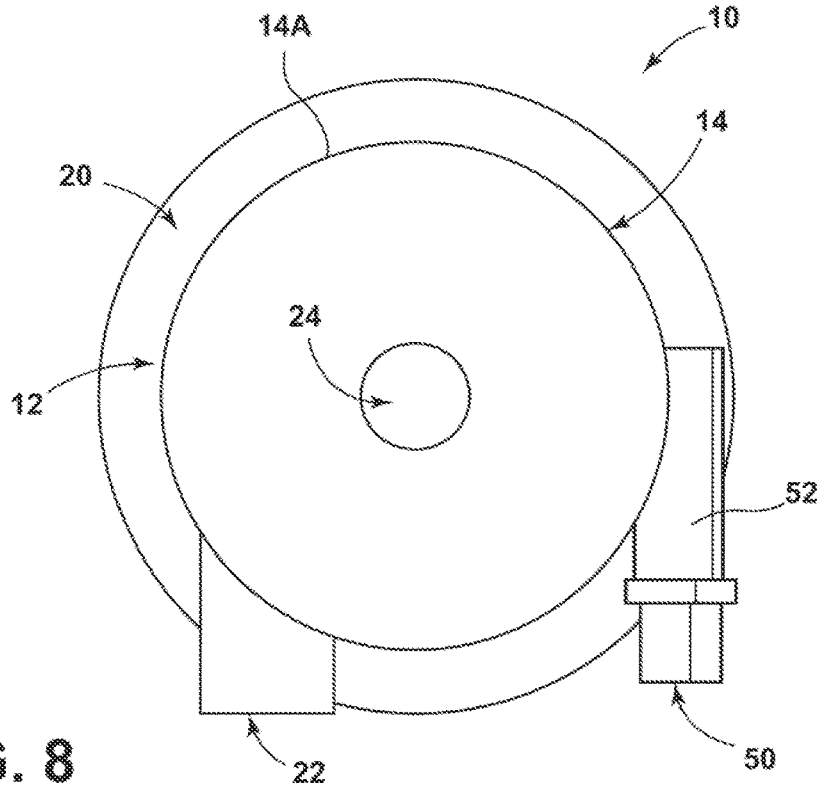
FIG. 8 is a top view of the separator assembly shown in FIG. 7.

As generally shown, the separator assembly 10 may also include one or more debris separation rings 30 disposed within the internal chamber 18 of the housing 12. For example, in a non-limiting embodiment, such as generally illustrated in FIGS. 5 and 6, the separator assembly 10 may include a first debris separation ring 30A and a second debris separation ring 30B (collectively "the debris separation rings 30"). Although two debris separation rings 30A and 30B are generally illustrated, the separator assembly 10 may theoretically include any suitable number of debris separation rings 30.

As generally disclosed below, the debris separation rings 30 may be configured to help separate and capture debris particles from fluid circulating through the housing 12. In an embodiment, the first and second debris separation rings 30A and 30B may be similar to one another in structure. Therefore, only the first debris separation ring 30A is generally disclosed in further detail below. It should be appreciated, however, that the first and second debris separation rings 30A and 30B need not be similar to one another, but may have different structural features or configurations.

As generally shown, the first debris separation ring 30A may be a generally annular ring that circumferentially extends around an inner surface of the housing 12. For example and without limitation, the first debris separation ring 30 may include a radially extending wall 32A and an axially extending wall 34A. The radially extending wall 32A may radially extend inwardly from the inner surface of the housing 12. The axially extending wall 34A may axially extend from an inner circumferential edge of the radially extending wall 32A so as to be generally parallel with and radially spaced from the inner surface of the housing 12. As such, an annular pocket or collection region 36A can be formed between the inner surface of the housing 12, the radially extending wall 32A, and the axially extending wall 34A. As generally disclosed below, a size and/or cross-sectional shape of the annular collection region 36A may be optimized or otherwise configured to achieve maximum separation and capture of debris particles having a particular size and/or a predetermined range of sizes. The debris separation rings 30 may have any suitable shapes or configurations without departing from the scope of the present disclosure.

It should also be appreciated that the debris separation rings 30 can be secured to or otherwise supported within the housing 12 using a suitable connection including, but not limited to, a press-fit connection, an adhesive, a welded connection, or another suitable connection. In other embodiments, for example, the debris separation rings 30 may be molded with the housing 12 using a suitable molding process.

Figure 9:
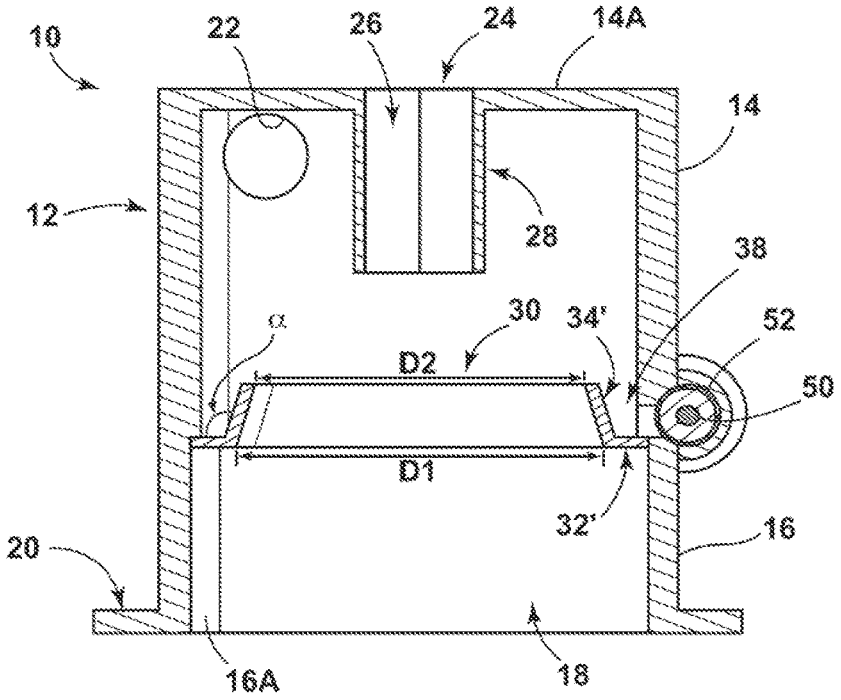
FIG. 9 is a front cross-sectional view of the separator assembly shown in FIG. 7.

In another embodiment, the separator assembly 10 may include a generally conically shaped debris separation ring 30, such as generally illustrated in FIG. 9. The debris separation ring 30 may include a first wall 32' that radially extends inwardly from the inner surface of the housing 12. The first wall 32' may include features similar to those described with respect to the radially extending wall 32.

The debris separation ring 30 may include a second wall 34' that extends conically from an inner circumferential edge of the first wall 32' at a predefined obtuse angle $\alpha$ relative to the first wall 32' such that the second wall 34' may define a conically shaped portion 35 of the debris separation ring 30.

The portion 35 includes a first diameter D1 disposed near the first wall 32' and a second diameter D2 disposed near an end of the second wall 34'. The end of the second wall 34' may be opposed to the first wall 32'. In the illustrated embodiment, the second diameter D2 is smaller than the first diameter D1. As such, an annular pocket or collection region 38 can be formed between the inner surface of the housing 12, the first wall 32', and the second wall 34'.

A size and/or cross-sectional shape of the annular collection region 38 may be optimized or otherwise configured to achieve improved (or even maximum) separation and capture of debris particles having a particular size and/or a predetermined range of sizes and to allow nuisance debris to be washed back into fluid exiting the separator assembly 10 through the opening 16A. Nuisance debris may be debris of a particular size or material that is not monitored by the sensor 50. For example, and without limitation, debris that is smaller than a particular size may be considered nuisance debris. As fluid, which may contain debris, including nuisance debris, is circulated through the housing 12, the nuisance debris may build up on a surface of the sensor 50. Overtime, enough nuisance debris build up may "blind" the sensor 50. In other words, functionality of the sensor 50 may be diminished as a result of nuisance debris build up. By allowing the nuisance debris to wash back into the fluid exiting the separator assembly 10, a reduced amount of nuisance debris is available to build up on the sensor 50, thereby, delaying, or preventing, sensor "blinding".

Figure 10:
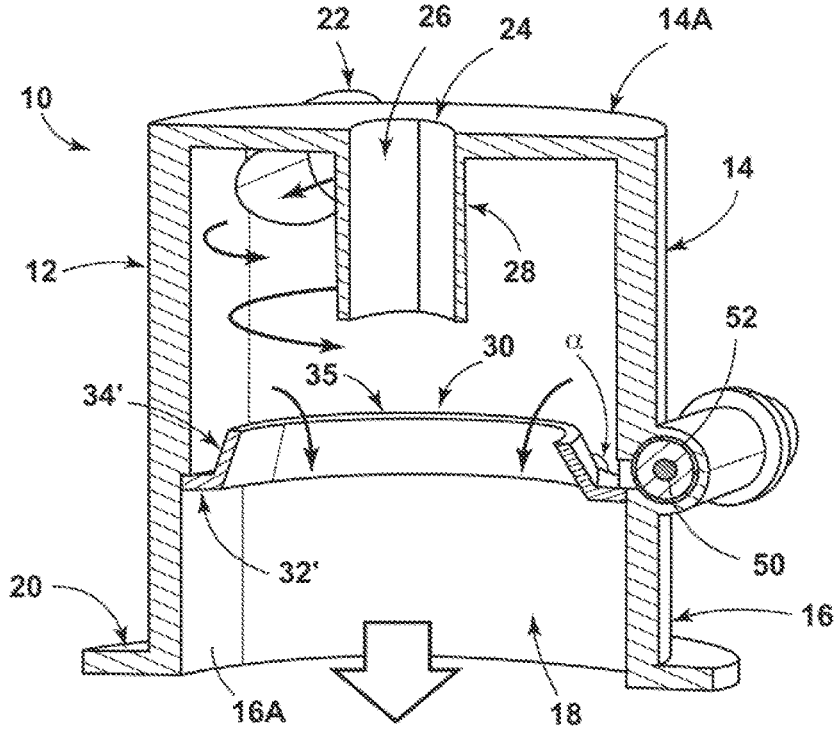
FIG. 10 is a perspective cross-sectional view of the separator assembly as shown in FIG. 9 illustrating a flow pattern of fluid passing through the separator assembly.

The size of the collection region 38 is related to the value of the angle $\alpha$. For example, the angle $\alpha$ may be greater than 90° (i.e., an obtuse angle) relative to the first wall 32', such as generally illustrated in FIGS. 9 and 10. A size associated with the collection region 38 is larger when the angle $\alpha$ is equal to 100° compared to a size associated with the collection region 38 when the angle $\alpha$ is equal to 90°. Further, the conical or cone-shaped portion 35 may be configured or sized to separate debris from fluid circulating through the housing 12 and to reduce or minimize fluid entrained in the air that is vented through the cylindrical bore 26.

Referring again to both debris separation rings 30, as generally shown in FIGS. 5 and 6, the first debris separation ring 30A and the second debris separation ring 30B may be spaced apart from one another a distance L along the longitudinal axis of the housing 12. As generally disclosed below, the distance L can be optimized or otherwise configured to achieve maximum discretization and capture of debris particles having differing sizes and weights. The debris separation rings 30 are also shown as being oriented in a generally horizontal plane relative to the first and second ends 14 and 16 of the housing 12 (i.e., perpendicular to a longitudinal axis of the housing 12). However, in other embodiments, the debris separation rings 30 may be oriented an angle, such as an acute angle, relative to the longitudinal axis of the housing 12. The debris separation rings 30 may also be oriented in a spiral or helix along the inner surface of the housing 12.

The separator assembly 10 may also include a plurality of debris ports, such as a first debris port 40A and a second debris port 40B (collectively "the debris ports 40"). As generally disclosed below, the debris ports 40 may be configured to collect debris particles that are captured by the respective debris separation rings 30. In an example and without limitation, the debris ports 40 may extend through the side wall of the housing 12 and can be in communication with the collection regions 36 of the respective debris separation rings 30. In this example, the first debris port 40A may be provided radially adjacent to the collection region 36A of the first debris separation ring 30A, and the second debris port 40B may be provided radially adjacent to the collection region 36B of the second debris separation ring 30B. It should be appreciated that the number of debris ports 40 may correspond to the number of debris separation rings 30, although such is not necessarily required. Further, as generally disclosed below, the dimensions and shape of the debris ports 40 may be optimized to respectively collect debris particles having a predetermined size or a range of sizes, if desired.

The separator assembly 10 may also include a plurality of sensors, such as a first sensor 50A and a second sensor 50B (collectively "the sensors 50"). The sensors 50 may be configured to detect the presence of debris particles in the respective debris ports 40. The sensors 50 may also provide an electronic signal to a control unit, for example, when a size of the captured debris particles reaches a predetermined threshold and/or falls within a specified range. For example and without limitation, a portion of the first sensor 50A may be in communication with the first debris port 40A of the first debris separation ring 30A, and a portion of the second sensor 50B may be in communication with the second debris port 40B of the second debris separator ring 30B. It should be appreciated that the number of sensors 50 may correspond to the number of debris separation rings 30 and debris ports 40, although such is not necessarily required.

In an embodiment, the sensors 50 may be removably supported on or otherwise attached to the housing 12. As such, the sensors 50 can be removed in order to, among other things, gain access to the debris ports 40 for removal of debris particles. For example, as generally shown, the sensors 50 may be respectively inserted into support sleeves 52A and 52B (collectively "the support sleeves 52") that can be formed in or otherwise provided adjacent to the side wall of the housing 12. In an embodiment, the supports sleeves 52 can be oriented in a generally perpendicular relationship relative to the longitudinal axis of the housing 12. However, the support sleeves 52 may also be oriented in any suitable relationship relative to the longitudinal axis. Further, the sensors 50 may be removably secured within the support sleeves 52 in any suitable manner including, but not limited to, a threaded connection, a press-fit connection, or a quick-disconnect style connection. A sealing member (e.g., an o-ring) may be optionally provided between each of the sensors 50 and the respective support sleeves 52 to form a sealed connection with the housing 12. In other embodiments, however, the sensors 50 may supported on or otherwise attached to the housing 12 in other suitable ways without departing from the scope of the present disclosure.

As briefly mentioned above, the sensors 50 may be configured to detect debris particles in the respective debris ports 40. For example and without limitation, the sensors 50 may be magnetic induction sensors that can be configured to detect the presence of metallic particles in the debris ports 40. It should be appreciated, however, that the sensors 50 may be other suitable sensors capable of detecting debris particles. As generally disclosed below, the respective sensors 50 may be individually optimized or otherwise calibrated to detect debris particles having different sizes and/or that fall within different specified ranges. In this example, and without limitation, the first sensor 50A can be optimized or calibrated to detect debris particles having a first or relatively larger size, while the second sensor 50B can be optimized or calibrated to detect debris particles having a second or relatively smaller size, or vice versa.

As generally shown in FIG. 5, an inner diameter of the housing 12 may progressively increase in size from a first end 14 of the housing 12 to the second end 16, although such may not be required. For example and without limitation, the housing 12 may have a first inner diameter DH1 located between the end wall 14A of the housing 12 and the first debris separator ring 30A. The housing 12 may have a second inner diameter DH2, which is larger than the first inner diameter DH1, located between the first debris separation ring 30A and the second debris separation ring 30B. Similarly, the housing 12 may have a third inner diameter DH3, which is larger than the first and second inner diameters DH1 and DH2, located between the second debris separation ring 30B and the second end 16 of the housing 12. If more than two debris separation rings 30 are provided, it should be appreciated that the inner diameters of the housing 12 may continue to progressively increase in size with each additional debris separation ring 30. It should also be appreciated that the relative increase in the respective inner diameters of the housing 12 may be optimized or otherwise configured to achieve maximum discretization and capture of debris particles having varying sizes and/or weights.

In a similar manner, an inner diameter of the respective debris separation rings 30 may progressively increase in size from the first end 14 of the housing 12 to the second end 16, although such may not be required. For example and without limitation, the first debris separation ring 30A may have a first inner diameter DR1, and the second debris separation ring 30B may have a second inner diameter DR2 that is larger than the first inner diameter DR1. If more than two debris separation rings 30 are provided, it should be appreciated that the inner diameters of the additional debris separation rings 30 may continue to progressively increase in size. Further, as described above, it should be appreciated that the relative increase in the respective inner diameters of the debris separation rings 30 may be optimized or otherwise configured to achieve maximum discretization and capture of debris particles having varying sizes and weights. As generally shown, the debris separation rings 30 may be concentrically aligned with one another relative to the longitudinal axis of the housing 12, although such may not be required.

An operation of the separator assembly 10 in accordance with the present disclosure will now be generally described with reference to FIGS. 6 and 10. A supply of fluid may be provided to the separator assembly 10 through the inlet port 22 of the housing 12. As generally explained above, the inlet port 22 may be oriented in a tangential relationship relative to the internal chamber 18. Therefore, as a result of gravity and the orientation of the inlet port 22, fluid entering the internal chamber 18 can be configured to travel in a cyclonic flow pattern (i.e., a vortex) downward through the internal chamber 18, as depicted by the arrows in FIGS. 6 and 10. The cyclonic flow pattern may create a centrifugal force that acts on debris particles, causing them to migrate in an outward direction within the fluid toward the inner surface of the housing 12. As fluid continues to travel downward along the inner surface of the housing 12, it flows over the one or more debris separation rings 30. As a result, debris particles can be captured in the respective collection regions 36 as generally depicted in FIG. 6 or the collection region 38 as generally depictured in FIG. 10 of the one or more debris separation rings 30.

As a result of centrifugal force, relatively larger and heavier debris particles may tend to migrate outwardly towards the inner surface of the housing 12 more quickly than relatively smaller and lighter debris particles. Thus, in the embodiment generally depictured in FIG. 6, the relatively larger and heavier debris particles may be captured by the first debris separator ring 30A. Conversely, the relatively smaller and lighter particles may need additional time and momentum to overcome the viscous properties of the fluid and, therefore, may tend to migrate outwardly towards the inner surface of the housing 12 more slowly than the relatively larger and heavier debris particles. Thus, the relatively smaller and lighter debris particles may be captured by the second debris separation ring 30B. Accordingly, the collection regions 36 of the debris separation rings 30, the distance L between the debris separation rings 30, and the inner diameters of the housing 12 and the debris separation rings 30 may be optimized or otherwise configured to achieve maximum discretization and capture of debris particles having different sizes and/or weights. Additionally or alternatively, the debris separation ring 30, such as generally depicted in FIG. 10, may allow nuisance debris to be washed out through the opening 16A while the collection region 38 captures all or a portion of the remainder of the debris particles from the fluid circulating within the housing 12.

As debris particles are captured by the one or more debris separation rings 30, they may be directed to the respective debris ports 40 where debris particles of a predetermined size and/or material can be detected by the sensors 50. As such, debris particles and other contaminates that are collected by the debris separation rings 30 can, when necessary, be removed from the separator assembly 10. As generally explained above, the debris particles can be removed from the separator assembly 10 by removing the sensors 50 from the housing 12.

To help reduce or prevent the sensors 50 from being "blinded" by nuisance debris, the respective debris ports 40 may also be optimized or otherwise configured to collect debris particles having a particular size and/or a predetermined range of sizes. It should also be appreciated that the respective sensors 50 may be individually optimized or calibrated to detect debris particles having a particular size and/or a predetermined range of sizes. Further, in the embodiment illustrated in FIG. 10, the conical portion 35 of the debris separation ring 30 and the angle $\alpha$ may be configured or otherwise optimized to allow nuisance debris to be washed out through the opening 16A.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims and their equivalents.

What is claimed is:

1. A separator assembly for separating debris particles from a fluid in a fluid system, the separator assembly comprising:

a housing forming an internal chamber;

an inlet port in fluid communication with the internal chamber of the housing, wherein the inlet port is oriented in a tangential relationship relative to the internal chamber;

a first debris separation ring disposed in the housing and extending around an inner surface of the internal chamber; and a second debris separation ring disposed in the housing and extending around the inner surface of the internal chamber, wherein the second debris separation ring is spaced from the first debris separation ring;

wherein the housing includes a first end having an end wall and a second end defining an opening; the first debris separation ring is located near the first end of the housing; the second debris separation ring is located near the second end of the housing; the housing has a first inner diameter located between the end wall at the first end of the housing and the first debris separation ring; the housing has a second inner diameter located between the first debris separation ring and the second debris separation ring; and the second inner diameter is larger than the first inner diameter.

2. The separator assembly of claim 1, wherein the first debris separation ring and the second debris separation ring each form an annular ring that circumferentially extends around an inner surface of the housing.

3. The separator assembly of claim 1, wherein the first debris separation ring and the second debris separation ring each includes an axially extending wall that is radially spaced from an inner surface of the housing and forms an annular collection region.

4. The separator assembly of claim 3, further including a first debris port extending through a side wall of the housing and in fluid communication with the annular collection region of the first debris separation ring, and a second debris port extending through a side wall of the housing and in communication with the annular collection region of the second debris separation ring.

5. The separator assembly of claim 4, further including a first sensor in communication with the first debris port, and a second sensor in communication with the second debris port.

6. The separator assembly of claim 5, wherein the first and second sensors are removably secured to the housing.

7. The separator assembly of claim 6, wherein the housing includes a first support sleeve and a second support sleeve, and the first sensor is disposed in the first support sleeve and the second sensor is disposed in the second support sleeve.

8. The separator assembly of claim 5, wherein the first sensor is configured or calibrated to detect debris particles having a first or relatively larger size, and the second sensor is configured or calibrated to detect debris particles having a second or relatively smaller size.

9. The separator assembly of claim 3, wherein the annular collection region of the first debris separation ring is configured to capture debris particles having a first or relatively larger size, and the annular collection region of the second debris separation ring is configured to capture debris particles having a second or relatively smaller size.

10. The separator assembly of claim 1, wherein the first debris separation ring has a first inner diameter, and the second debris separation ring has a second inner diameter that is larger than the first inner diameter.

11. A separator assembly for separating debris particles from a fluid in a fluid system, the separator assembly comprising:

a housing defining a circular cylindrical internal chamber having a closed first end and an open second end;

an inlet port in fluid communication with the internal chamber of the housing, wherein the inlet port is located near the closed first end of the housing and is oriented in a tangential relationship relative to the internal chamber;

a first debris separation ring disposed in the housing and extending around an inner surface of the internal chamber, wherein the first debris separation ring includes an axially extending wall that is radially spaced from an inner surface of the housing and forms a first annular collection region;

a second debris separation ring disposed in the housing and extending around the inner surface of the internal chamber, wherein the second debris separation ring is spaced an axial distance from the first debris separation ring, and the second debris separation ring includes an axially extending wall that is radially spaced from an inner surface of the housing and forms a second annular collection region;

a first debris port extending through a side wall of the housing and in fluid communication with the first annular collection region of the first debris separation ring;

a second debris port extending through a side wall of the housing and in communication with the second annular collection region of the second debris separation ring;

a first sensor in communication with the first debris port; and a second sensor in communication with the second debris port.

12. The separator assembly of claim 11, wherein the first annular collection region of the first debris separation ring is configured to capture debris particles having a first or relatively larger size, and the second annular collection region of the second debris separation ring is configured to capture debris particles having a second or relatively smaller size.

13. The separator assembly of claim 11, wherein the first debris separation ring has a first inner diameter, and the second debris separation ring has a second inner diameter that is larger than the first inner diameter.

14. The separator assembly of claim 11, wherein the housing has a first inner diameter located between the closed first end of the housing and the first debris separation ring, and the housing has a second inner diameter located between the first debris separation ring and the second debris separation ring, and the second inner diameter is larger than the first inner diameter.

15. A separator assembly for separating debris particles from a fluid in a fluid system, the separator assembly comprising:

a housing forming an internal chamber;

an inlet port in fluid communication with the internal chamber of the housing, wherein the inlet port is oriented in a tangential relationship relative to the internal chamber; and a first debris separation ring disposed in the housing and extending around an inner surface of the internal chamber, the first debris separation ring comprising a first wall radially extending inward from an inner surface of the housing and a second wall extending from an inner circumferential edge of the first wall; and a second debris separation ring disposed in the housing and extending around the inner surface of the internal chamber, wherein the second debris separation ring is spaced from the first debris separation ring;

wherein the first debris separation ring has a first inner diameter, and the second debris separation ring has a second inner diameter that is larger than the first inner diameter.

16. The separator assembly of claim 15, wherein the first debris separation ring forms a conical ring that circumferentially extends around the inner surface of the housing.

17. The separator assembly of claim 16, wherein a space between the first wall, the second wall, and the inner surface of the housing forms a collection region configured to capture debris particles having a relatively larger size and to allow nuisance particles to be washed out of the housing through an opening disposed near an end of the housing.

18. The separator assembly of claim 15, wherein the housing includes a first end having an end wall and a second end defining an opening, and the first debris separation ring is located near the first end of the housing and the second debris separation ring is located near the second end of the housing.

19. The separator assembly of claim 18, wherein the internal chamber of the housing defines a circular cylindrical internal chamber.

20. The separator assembly of claim 18, wherein the second debris separation ring is spaced an axial distance from the first debris separation ring.

21. The separator assembly of claim 18, wherein the inlet port is located axially adjacent to the end wall at the first end of the housing.

22. The separator assembly of claim 18, wherein the housing has a first inner diameter located between the end wall at the first end of the housing and the first debris separation ring, and the housing has a second inner diameter located between the first debris separation ring and the second debris separation ring, and the second inner diameter is larger than the first inner diameter.

23. The separator assembly of claim 22, wherein the housing has a third inner diameter located between the second debris separation ring and the second end of the housing, and the third inner diameter is larger than the first and second inner diameters.

* * * * *